US007170386B2

(12) United States Patent
Meier et al.

(10) Patent No.: US 7,170,386 B2
(45) Date of Patent: Jan. 30, 2007

(54) INDUCTOR CORE FOR HEATABLE GODET ROLL

(75) Inventors: Klaus Meier, Geislingen/Steige (DE); Thomas Digel, Ofterdingen (DE); Roland Reiber, Reutlingen (DE)

(73) Assignee: Schärer Schweiter Mettler AG, Horgen (CH)

( * ) Notice: Subject to any disclaimer, the term of this patent is extended or adjusted under 35 U.S.C. 154(b) by 34 days.

(21) Appl. No.: 11/172,183

(22) Filed: Jun. 30, 2005

(65) Prior Publication Data

US 2006/0006978 A1 Jan. 12, 2006

(30) Foreign Application Priority Data

Jul. 6, 2004 (EP) ..... 04015841

(51) Int. Cl.
*H01F 27/24* (2006.01)

(52) U.S. Cl. ..... 336/234; 219/619

(58) Field of Classification Search ..... 336/65, 336/83, 210–213, 216, 233–234; 219/600, 219/618–619

See application file for complete search history.

(56) References Cited

U.S. PATENT DOCUMENTS 3,448,233 A 6/1969 Landis
3,562,472 A * 2/1971 Cannon et al. ..... 219/619
4,304,975 A * 12/1981 Lenk et al. ..... 219/619
5,970,592 A * 10/1999 Feldhoff et al. ..... 28/240

FOREIGN PATENT DOCUMENTS

| | | |
|---|---|---|
| CH | 467 363 | 7/1968 |
| DE | 1957 110 | 7/1970 |
| EP | 0 845 196 B1 | 6/1997 |

* cited by examiner

*Primary Examiner*—Tuyen T Nguyen
(74) *Attorney, Agent, or Firm*—Walter A. Hackler

(57) ABSTRACT

An inductor core 10 is proposed for a heatable godet roll comprising a plurality of inductor core laminations 11 arranged radially in a star shape with radial sections 12 and respectively one outer axial section 13 and an inner axial section. The inductor core 10 has end plates 19, 20 with respectively one surface 21 complementary to the radial sections 12 and fixing means, wherein the inductor core laminations 11 are arranged between the end plates 19, 20 and wherein the fixing means 22 are set up to fix the inductor core laminations 11 at their radiation sections 12 on the end plates 19, 20 or alternatively and/or on the outer surface of an inner tube.

10 Claims, 3 Drawing Sheets

INDUCTOR CORE FOR HEATABLE GODET ROLL

BACKGROUND OF THE INVENTION

The invention relates to an inductor core for an inductively heatable godet roll as well as an inductor and an inductively heatable godet roll. The inductor core comprises a plurality of inductor core laminations arranged radially in a star shape with radial sections and respectively one outer and one inner axial section. In the inductor a sleeve is arranged around the inductor core laminations, wherein the outer axial sections of the inductor core laminations are adjacent to the sleeve. These godet rolls are used in spinning machines or on machines for manufacturing fibres, e.g. yarns, as guide rollers and take-off rolls for the fibres to be processed.

Inductively heatable godet rolls are known in the prior art. These godet rolls have a magnetic inductor core which is wound with coil windings wherein the coil windings are acted upon by an electrical alternating current. The coil windings together with the inductor core form an inductor which makes it possible to inductively heat the godet roll. The inductor core thereby brings about a focussing and amplification of the magnetic field generated by the coil windings through which current flows. The magnetic field induced by the inductor induces electrical eddy currents in the electrically conducting parts of the godet roll which heat the electrically conducting parts and therefore the godet roll.

Inductor cores of cast iron are known. Inductor cores of cast iron can be manufactured cheaply but at low magnetic field strengths, i.e., at around 1100 VA, the inductor cores reach magnetic saturation which makes it difficult for the magnetic field generated by the electric current flowing in the coil windings to penetrate into the inductor core. Thus, high heating powers which make it possible to heat the surfaces of the godet roll coming in contact with the fibres to be processed to a temperature of 240° or higher required in various fibre processing methods, are difficult to achieve using cast-iron inductor cores. In addition, electrical eddy currents are also induced in these inductor cores. This results in heating of the inductor core itself which makes it difficult to quickly control the godet roll temperature.

Temperatures of 240° C. can be achieved when the power consumption of the godet roll is 1100 VA but only at low rotation speeds of the godet roll. Most power is used to compensate for the heat losses to the environment of the rapidly rotating godet roll. As the rotation speed increases, this heat loss increases quadratically. 1100 VA is a power limit for a godet roll having an overall size of 90 mm length and 100 mm diameter. Larger godet rolls allow higher heating powers with a cast-iron inductor core. However, an increase in the size of the godet roll results in a larger surface of the godet roll whereby the loss of heat energy proportional to this surface increases. A large fraction of the heating power obtained by increasing the size of the godet roll is thereby compensated.

Inductors with laminated inductor cores are further known. In these inductor cores, inductor core laminations arranged radially spaced apart in a star shape, having radial sections and respectively one outer and one inner axial section are arranged around an inner tube such that the inductor core laminations have their inner axial section respectively adjacent to the outer surface of the inner tube. In this case, the inductor core laminations are welded with their inner axial section respectively on the outer surface of the inner tube. The inductor core laminations are made of transformer sheet metal. The inductor core is wound with coil windings. During winding care must be taken to ensure that any insulation of the wire used to construct the coil windings is not damaged. Laminated inductor cores prevent the formation of eddy currents in the inductor core in accordance with a laminated transformer core. If the sleeve is made of an electrically conductive material, e.g. of steel, eddy currents are induced in the sleeve, resulting in heating of the sleeve and thus of the godet roll into which the inductor is inserted. The inductor core itself is not significantly heated by the lamination of the inductor core. Local heating near the surface of the godet roll is achieved. As a result of the material used to manufacture the laminations, laminated inductor cores have significantly higher magnetic saturation limits than cast-iron inductor cores whereby substantially higher magnetic fields can be generated by means of the inductors. A disadvantage with known laminated inductor cores is that the inductor core laminations must be welded individually to the inner tube. Further, it is expensive to arrange the inductor core laminations in a star shape i.e., spaced apart at the outer diameter. For this purpose, the metal sheets from which the inductor core laminations are made, are provided with a lug as a spacer at their outer regions. During assembly of the inductor core the metal sheets are then arranged individually. For better fixing the sheets can be fixed to a sleeve using a welded seam whereby disadvantageous eddy currents are produced during operation of a godet roll fitted with an inductor core of this type.

High heating powers can certainly be achieved with laminated inductor cores but they are expensive to manufacture and therefore cost-intensive.

The documents DE 19 57 110 A1 and CH 467 363 A each disclose a heatable godet roll with an inductor core comprising a plurality of inductor core laminations arranged radially in a star shape, wherein fixing means are provided as locating means. The locating means are formed circumferentially on end plates to prevent the inductor core laminations from slipping in a radial direction.

Document U.S. Pat. No. 3,448,233 discloses a heatable godet roll with an inductor core which comprises a plurality of inductor core laminations arranged radially in a star shape and being formed from rectangular packages of sheet metal.

It is the object of the invention to provide an inductor core and an inductor for an inductively heated godet roll and an inductively heatable godet roll which avoid the disadvantages of the prior art and especially are simple to manufacture and make it possible to achieve a high heating power.

SUMMARY OF THE INVENTION

This object is solved by the inductor core according to claim 1, the inductor according to claim 9 and the godet roll according to claim 10. The dependent claims represent preferred embodiments of the invention.

The object is solved with respect to the inductor core by an inductor core for a heatable godet roll comprising a plurality of inductor core laminations arranged radially in a star shape with radial sections and respectively one outer axial section and one inner axial section. The inductor core comprises fixing means embodied as locating devices, wherein the fixing means are set up to fix the inductor core laminations at their edge sections on end plates with respectively one surface complementary to the radial sections. In this case, inductor core laminations are arranged between the end plates. The fixing means embodied as locating means are embodied as tongue-and-groove locating means which are arranged on the end plates and on the radial sections and extend in a radial outward direction. The locating means are executed according to tongue-and-groove plug connections wherein the radial sections of the inductor core laminations are preferably inserted as tongues into matching complementary grooves in the end plates, that is located. This involves an embodiment of the fixing means which is especially easy to manufacture. Additionally, the fixing means can be set up to locate the inductor core laminations with the inner tube, with their inner axial sections on an outer surface of an inner tube. Thus, the inductor core has end plates with one surface complementary to each radial sections. The inductor core laminations are arranged between the end plates and the fixing means are set up to fix the inductor core laminations on the end plates at their radial sections. The complementary surfaces of the end plates point towards the radial sections of the inductor core laminations. The surfaces have a shaping which forms the radial sections. In the simplest case, the radial sections and/or the axial sections are straight edges of preferably punched-out metal sheets. The shaping on the surfaces of the end plates is embodied as grooves running radially outwards from a central point of the respective plate into which respectively one radial section of the inductor core laminations can be inserted. This results in a positional fixing of the inductor core laminations relative to the end plates.

No welding processes are required to manufacture the inductor core according to the invention. The inductor core laminations are fixed in position by simply combining and/or assembling on the end plates or the inner tube. A laminated inductor core is provided which combines the advantages of known laminated inductor cores with simple and inexpensive manufacturability. Heating powers of 1000 Watt and higher can be achieved with the inductor core according to the invention whereby the surfaces of a godet roll coming in contact with fibres to be processed can be heated above 240° C. Precise heating with rapid changes in temperature can be achieved. Furthermore, the inductor core length can be varied very simply by varying the length of the inductor core laminations without incurring additional expenditure for assembly.

The inductor core laminations are especially preferably constructed as rectangular packages of sheet metal preferably with moulded-on spacers. Rectangular sheet-metal packages can be constructed very favourably from stamped sheet-metal parts as in transformers. The arrangement of a plurality of rectangular sheet-metal packages facilitates the assembly of the inductor core according to the invention compared with an embodiment with a plurality of individual metal sheets as inductor core laminations, wherein the magnetic properties can have the same values. The spacers prevent the metal sheets from being able to be joined in an electrically conducting fashion over a large area, which makes the formation of eddy currents additionally difficult. In addition, a regular spacing is achieved between the metal sheets whereby a symmetrical magnetic field can be produced and uniform heating of the godet roll can thus be achieved.

The metal sheets are preferably embodied as stamped parts. This makes it possible to fabricate the inductor core laminations simply and quickly. The inductor core laminations are preferably manufactured, e.g. stamped, from transformer sheet metal.

With particular preference, the locating means each comprise one circumferential groove in the end plates and elevations complementary thereto on the radial sections and radial grooves complementary to the radial sections in the end plates. This embodiment of the locating means is especially suitable for fixing the position of inductor core laminations executed as a sheet metal package. In this case, the packages are prevented from slipping in the radial direction by the circumferential groove and from slipping and/or twisting perpendicular to the radial direction by the radial groove.

The inductor core laminations especially preferably have radial-section extensions of the radial sections which extend over their outer axial sections. This form of inductor core laminations makes it possible to guide the magnetic field effectively from the area of the inductor core into the electrically conducting parts of the godet roll. These parts can then be heated especially quickly and effectively. In addition, a sleeve provided with coil windings can then be fixed in position on the inductor core laminations.

The end plates are preferably screwed together using screws running axially, preferably guided in intermediate spaces between the inductor core laminations. This type of screw connection makes it possible to fix the inductor core laminations stably in the axial direction of the inductor core. The end plates and the inductor core laminations are held together axially fixedly. The screws themselves additionally intensify the generated magnetic field if they are guided between the inductor core laminations.

The end plates are preferably made of a non-magnetic material, e.g. aluminium. This avoids any intensification of the field in the axial direction from the area of the inductor core. In addition to the inductor core according to the invention, an inductor according to the invention additionally comprises coil windings wherein the coil windings are wound on the inductor core. The coil windings can also be wound on a sleeve surrounding the inductor core. The coil form, i.e., the coil windings on the sleeve, can then be prefabricated. The inductor core can then be inserted into the coil form or the inductor core laminations are inserted individually in the sleeve to assemble the inductor and the end plates are then added, the fixing means, i.e., preferably the locating means, being suitably positioned and if appropriate then screwed axially to the inductor core.

A heatable godet roll according to the invention has a cylindrical basic shape wherein an inductor according to the invention is arranged in the godet roll.

The invention is explained in detail subsequently using exemplary embodiments with reference to the drawings.

Figure 1:
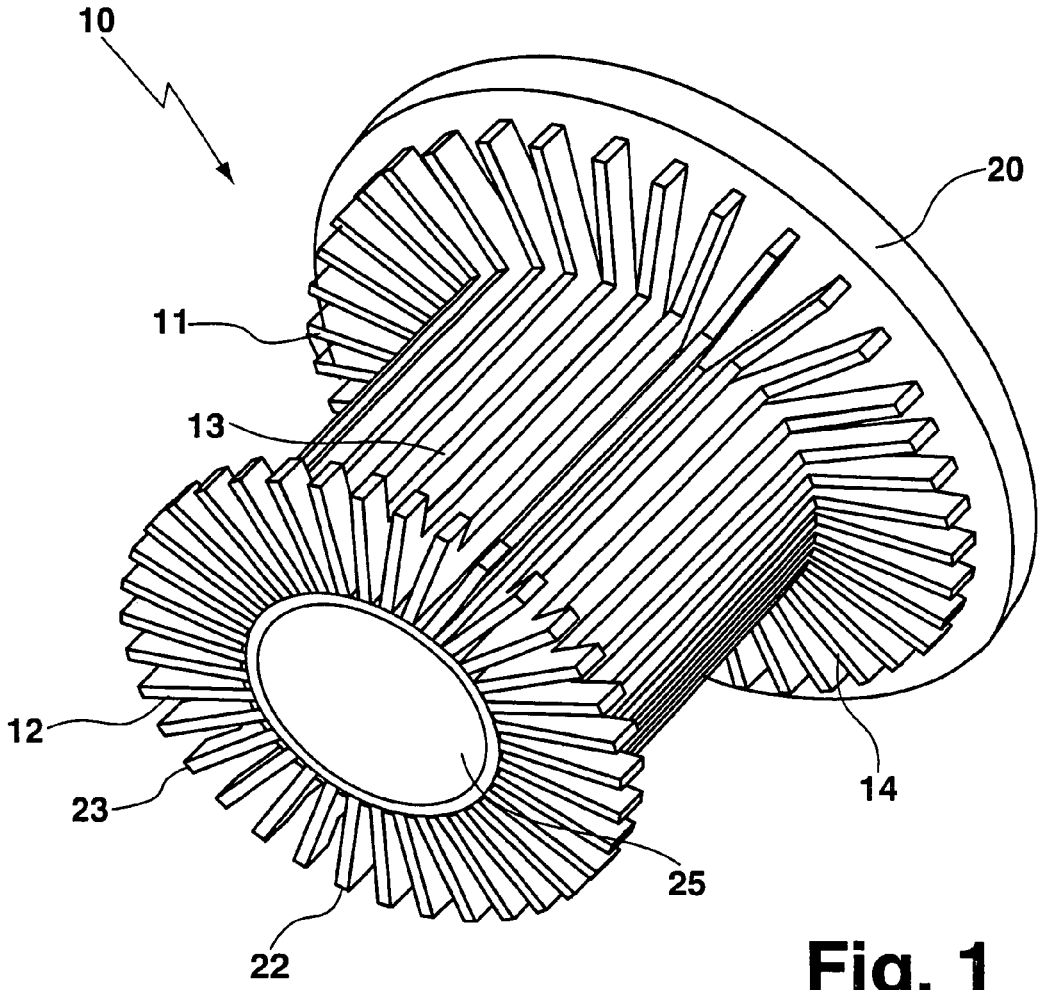
FIG. 1 shows an inductor core according to the invention wherein an end plate is shown swung away in FIG. 1*a* to illustrate the complementary surface and the fixing means.

The figures in the drawings show the subject matter according to the invention highly schematically and should not be understood as being to scale. The individual components of the subject matter according to the invention are show so that their structure can be shown clearly.

BRIEF DESCRIPTION OF THE PREFERRED EMBODIMENT

Figure 1A:
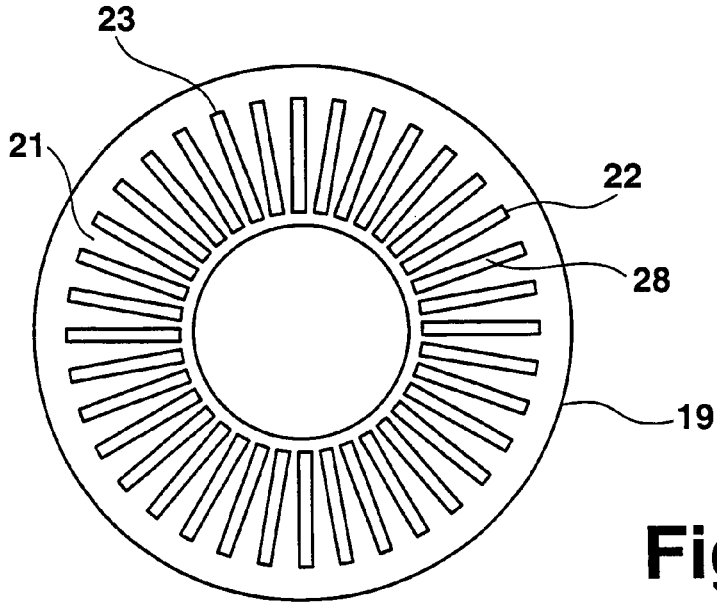

FIG. 1 shows an inductor core 10 according to the invention. The inductor core 10 has a plurality of inductor core laminations 11 arranged radially in a star shape with radial sections 12 and respectively one outer axial section 13 and one inner axial section. The inductor core 10 comprises two end plates 19, 20, preferably made of a non-magnetic material e.g. aluminium, each having a surface 21 complementary to the radial sections 12 and fixing means 22. The inductor core laminations 11 are arranged between the end plates 19, 20. The fixing means 22 are set up to fix the inductor core laminations 11 on the end plates 19, 20 at their radial sections 12. The inductor core laminations 11 have radial-section extensions 14 of the radial extensions 12 which extend over their outer axial sections 13. An end plate 19 is shown swung away in FIG. 1*a* to illustrate the complementary surface 21 and thus the fixing means 22. The fixing means 22 are embodied as locating means 23 arranged radially on the end plates 19, 20 and on the radial sections 12. The locating means are formed from the regions of the inductor core laminations 11 adjacent to the radial sections 12 and radial grooves 28 in the end plates 19, 20. In the simplest case, the radial grooves 28 comprise slits in the end plates 19, 20 which correspond in length and width to the radial sections 12 of the inductor core laminations 11. The inductor core laminations 11 are arranged around an inner tube 25 such that the inner axial sections of the inductor core laminations 11 are adjacent to the inner tube 25.

This prevents any slippage of the inductor core laminations inwards in the radial direction. However, it is possible to dispense with an inner tube since the inductor core laminations can be fixed in position in the radial direction by suitably forming the fixing means on the end plates 19, 20.

Figure 2:
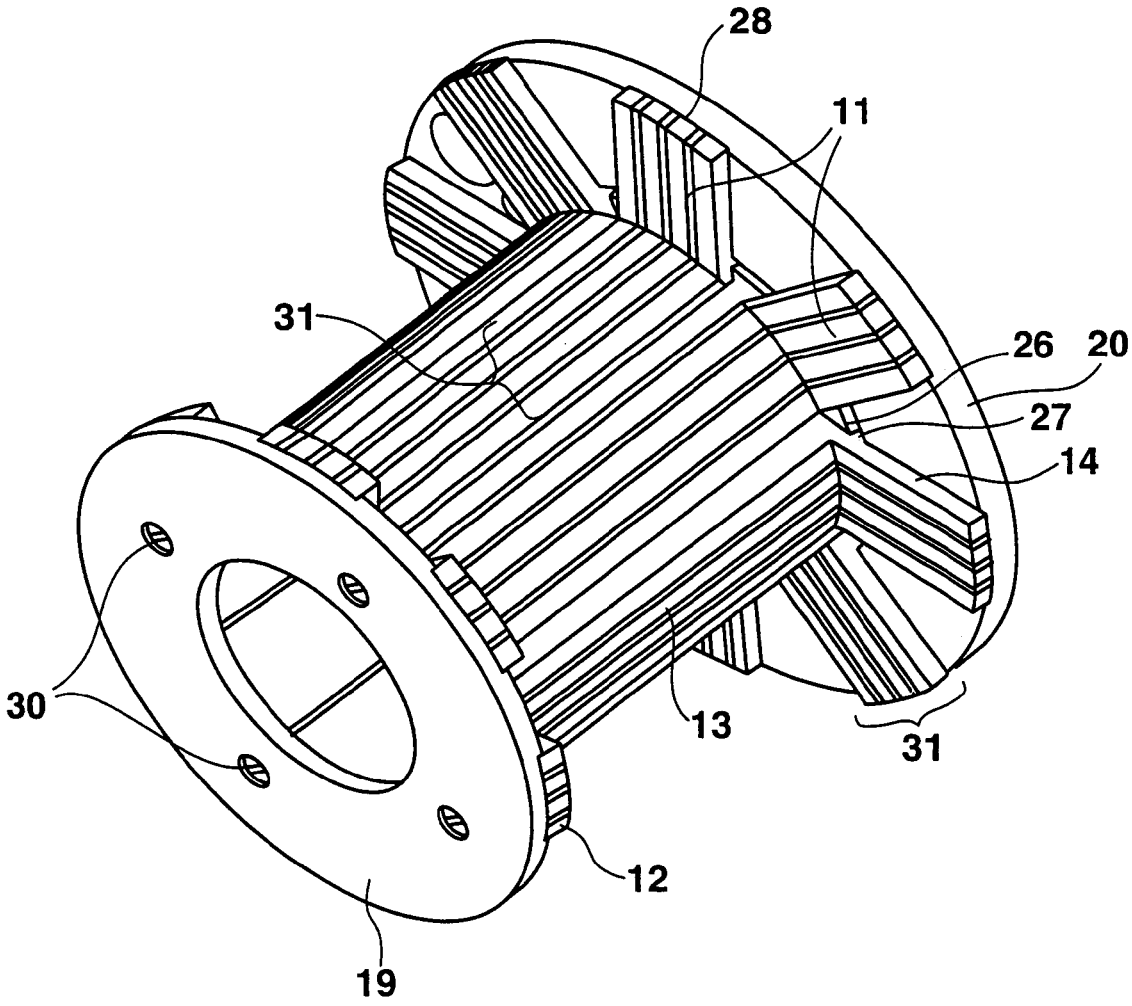
FIG. 2 shows a preferred embodiment of an inductor core according to the invention with inductor core laminations embodied as rectangular packages of sheet metal.

FIG. 2 shows a preferred embodiment of an inductor core according to the invention with inductor core laminations 11 embodied as approximately rectangular packages 31 of sheet metal. For example, eight packages 31 for which grooves 28 are provided in the end plates 19, 20 can be arranged in a star shape. The inductor core laminations 11, that is the individual metal sheets from which the inductor core laminations are joined together have radial-section extensions 14 of the radial sections 12 which extend over their outer axial sections 13. The locating means are embodied as respectively one circumferential groove 26 for radial fixing of the inductor core laminations 11 in the end plates 19, 20 and elevations 27 complementary thereto on the radial sections 12 of the inductor core laminations 11, and radial grooves 28 complementary to the radial sections 12 of the inductor core laminations 11 in the end plates 19, 20. The end plates 19, 20 are screwed together with screws 30 running axially and guided in intermediate spaces between the inductor core laminations 11. The metal sheets from which the inductor core laminations are joined together can be embodied as stamped parts. The individual sheets can also be insulated from one another with an electrically insulating layer.

Figure 3:
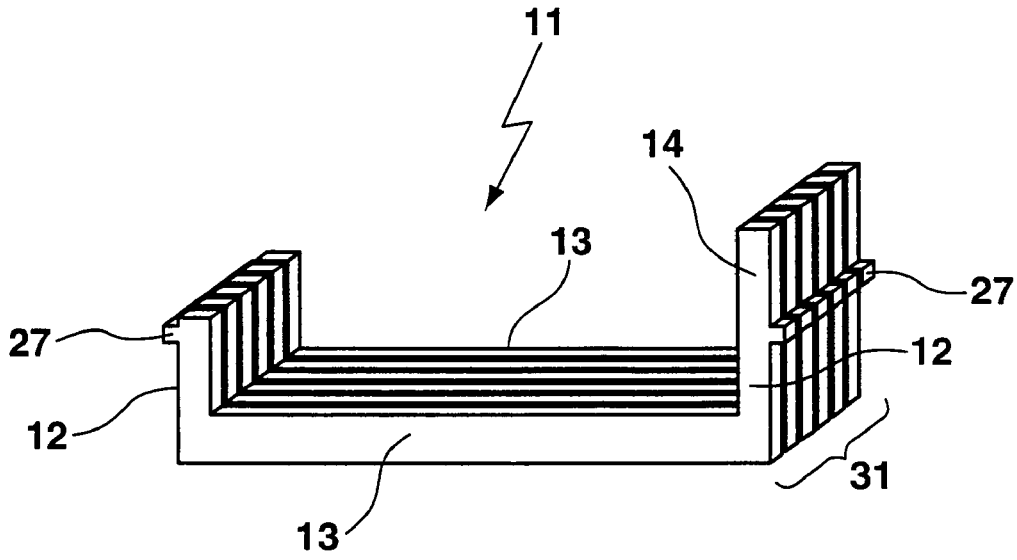
FIG. 3 shows an inductor core lamination embodied as a package of sheet metal as used to construct an inductor core according to the diagram in FIG. 2.

FIG. 3 shows a package 31 of inductor core laminations 11 such as used to construct the inductor core according to the diagram in FIG. 2. The package 31 comprises six metal sheets. The individual inductor core lamination 11 has a radial section 12 where a radial-section extension 14 extends over the outer axial section 13 of the inductor core lamination 11. The inductor core lamination 11 has elevations 27 on the radial sections 12 in the area of the radial-section extension 14. These elevations 27 are suitable for locating with the end plates the package 31 of inductor core laminations 11, as shown in FIG. 2, in accordance with a tongue-and-groove joint, in circumferential grooves in the surfaces of the end plates. The individual sheets of the package 31 have a form corresponding to the described form of the inductor core lamination 11.

Figure 4:
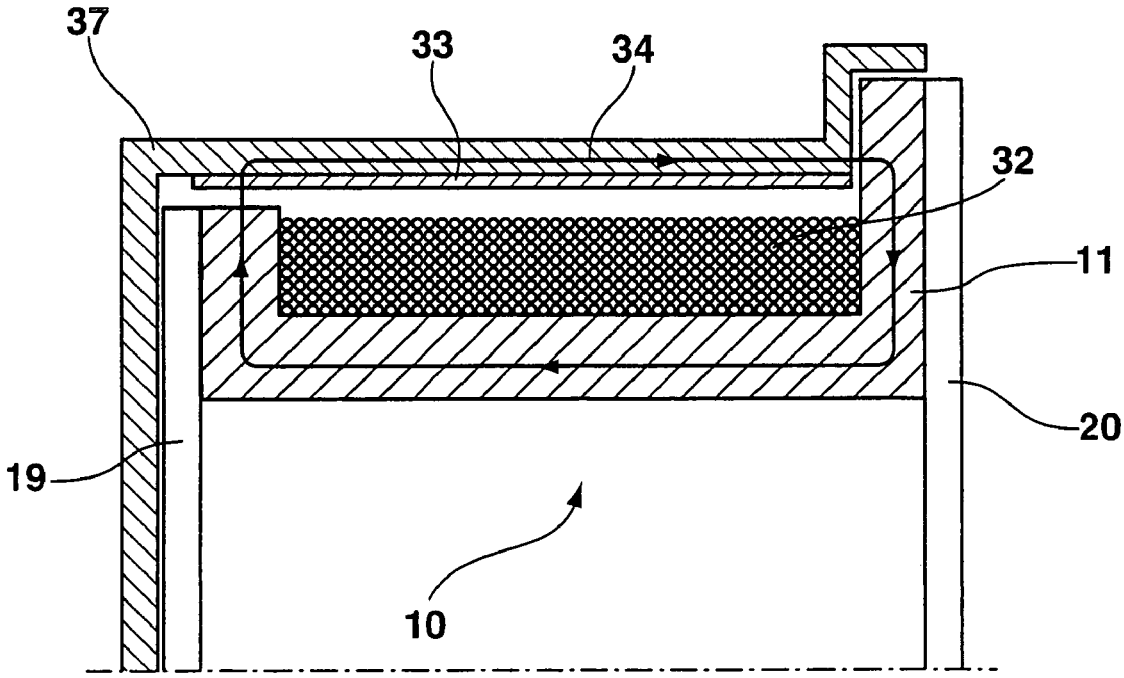
FIG. 4 shows a cross-section through an inductively heated godet roll according to the invention.

FIG. 4 shows a cross-section through an inductively heated godet roll according to the invention, where only one upper half of the godet roll above the axis of rotation of the godet roll is shown. The inductor core 10, the coil windings 32, the godet-roll jacket 37 of the cylinder forming the basic shape of the godet roll and the end plates 19, 20 are shown. The godet-roll jacket 37 forms a short-circuit ring for the magnetic field lines 34 of the magnetic field induced by the inductor core 10. The induced current is amplified via a copper ring 33 for example.

The invention is not restricted to the exemplary embodiments specified previously. Rather, it is possible to have a plurality of variants which make use of the features of the invention in a fundamentally different type of design.

An inductor core 10 is proposed for a heatable godet roll comprising a plurality of inductor core laminations 11 arranged radially in a star shape with radial sections 12 and respectively one outer axial section 13 and one inner axial section. The inductor core 10 has end plates 19, 20 with respectively one surface 21 complementary to the radial sections 12 and fixing means 22, wherein the inductor core laminations 11 are arranged between the end plates 19, 20 and wherein the fixing means 22 are set up to fix the inductor core laminations 11 at their radiation sections 12 on the end plates 19, 20 or alternatively and/or on the outer surface of an inner tube.

We claim:

1. An inductor core for a heatable godet roll, said inductor core comprising:

a plurality of inductor core laminations arranged radially in a star shape with radial sections and respectively one outer axial section and one inner axial section;

fixing means, embodied as locating devices for fixing the inductor core laminations at the radial sections on end plates with respectively one surface complementary to the radial sections so that the inductor core laminations are arranged between the end plates; and the locating devices include tongue-and-groove locators arranged on the end plates and on the radial sections and extend radially outward.

2. The inductor core for a heatable godet roll according to claim 1, wherein the inductor core laminations are constructed as almost rectangular packages of sheet metal.

3. The inductor core for a heatable godet roll according to claim 2, wherein the metal sheets are stamped parts.

4. The inductor core for a heatable godet roll according to claim 1, wherein the fixing means are set up to locate the inner axial sections of the inductor core laminations on an outer surface of an inner tube.

5. The inductor core for a heatable godet roll according to claim 1, wherein the locating means include one circumferential groove in the end plates and elevations complementary thereto on the radial sections and radial grooves complementary to the radial sections in the end plates.

6. The inductor core for a heatable godet roll according to claim 1, wherein the inductor core laminations have radial-section extensions of the radial sections which extend over outer axial sections.

7. The inductor core for a heatable godet roll according to claim 1, wherein the end plates are screwed together using screws running axially and guided in intermediate spaces between the inductor core laminations.

8. The inductor core for a heatable godet roll according to claim 1, wherein the end plates are made of a non-magnetic material.

9. An inductor for a heatable godet roll, said inductor comprising:

an inductor core including:

a plurality of inductor core laminations arranged radially in a star shape with radial sections and respectively one outer axial section and one inner axial section;

fixing means embodied as locating devices for fixing the inductor core laminations at the radial sections on end plates with respectively one surface complementary to the radial sections so that the inductor core laminations are arranged between the end plates;

the locating devices include tongue-and-groove locators arranged on the end plates and on the radial sections and extend radially outward; and coil winding wound around the inductor laminations.

10. A heatable godet roll comprising:

a cylinder; and an inductor, said inductor comprising an inductor core including:

a plurality of inductor core laminations arranged radially in a star shape with radial sections and respectively one outer axial section and one inner axial section;

fixing means embodied as locating devices for fixing the inductor core laminations at the radial sections on end plates with respectively one surface complementary to the radial sections so that the inductor core laminations are arranged between the end plates;

the locating devices include tongue-and-groove locators arranged on the end plates and on the radial sections and extend radially outward; and coil winding wound around the inductor core laminations.

* * * * *